US005322172A

United States Patent [19]

Maglione

[11] Patent Number: 5,322,172

[45] Date of Patent: Jun. 21, 1994

[54] COLLAPSIBLE DISPLAY STAND

[76] Inventor: Stephen T. Maglione, 15 Ava Maria Ct., Millington, N.J. 07946

[21] Appl. No.: 103

[22] Filed: Jan. 4, 1993

[51] Int. Cl.[5] ..... A47F 5/00

[52] U.S. Cl. ..... 211/132; 211/149; 248/174

[58] Field of Search ..... 211/132, 149, 186, 188, 211/133; 108/111; 248/174

[56] References Cited

U.S. PATENT DOCUMENTS

| | | | |
|---|---|---|---|
| 3,987,737 | 10/1976 | Smith . | |
| 4,274,613 | 6/1981 | Taub | 248/174 X |
| 4,311,100 | 1/1982 | Gardner | 108/111 |
| 4,493,424 | 1/1985 | Smith . | |
| 4,506,790 | 3/1985 | Muscari . | |
| 4,519,319 | 5/1985 | Howlett . | |
| 4,813,536 | 3/1989 | Willis | 248/174 X |
| 4,854,246 | 8/1989 | Belokin et al. . | |
| 4,942,830 | 7/1990 | Macaluso et al. . | |
| 5,000,329 | 3/1991 | Luberto | 211/132 |
| 5,240,127 | 8/1993 | Levin et al. | 211/133 X |

*Primary Examiner*—Robert W. Gibson, Jr.

[57] ABSTRACT

First and second corrugated single ply paperboard side members are formed of rectangular tubular nested boxes to provide rigid elongated members. The members are secured to a corrugated single ply box-like collapsible paperboard stiffening structure at a base region which rigidly spaces the side members in a display state and which secures the side members together in the collapsed state. A plurality of single ply corrugated shelves are releaseably interlocked to and between the side members to provide additional bracing action. A like plurality of single ply corrugated article receiving display trays releaseably rest on the shelves and are horizontally immobilized with a tab arrangement. A cap is releaseably secured on the tops of the side members to stiffen the side members in the display state relative to each other. A tray assembly is placed over the cap and releaseably rests on the cap with a pair of oppositely disposed trays which slope downwardly at the top of the display stand. The trays, shelves, cap and tray assembly are removed and the box-like structure placed in a collapsible state wherein the side members are in closely spaced juxtaposed relation for portability. A relatively tall portable structure is provided.

27 Claims, 9 Drawing Sheets

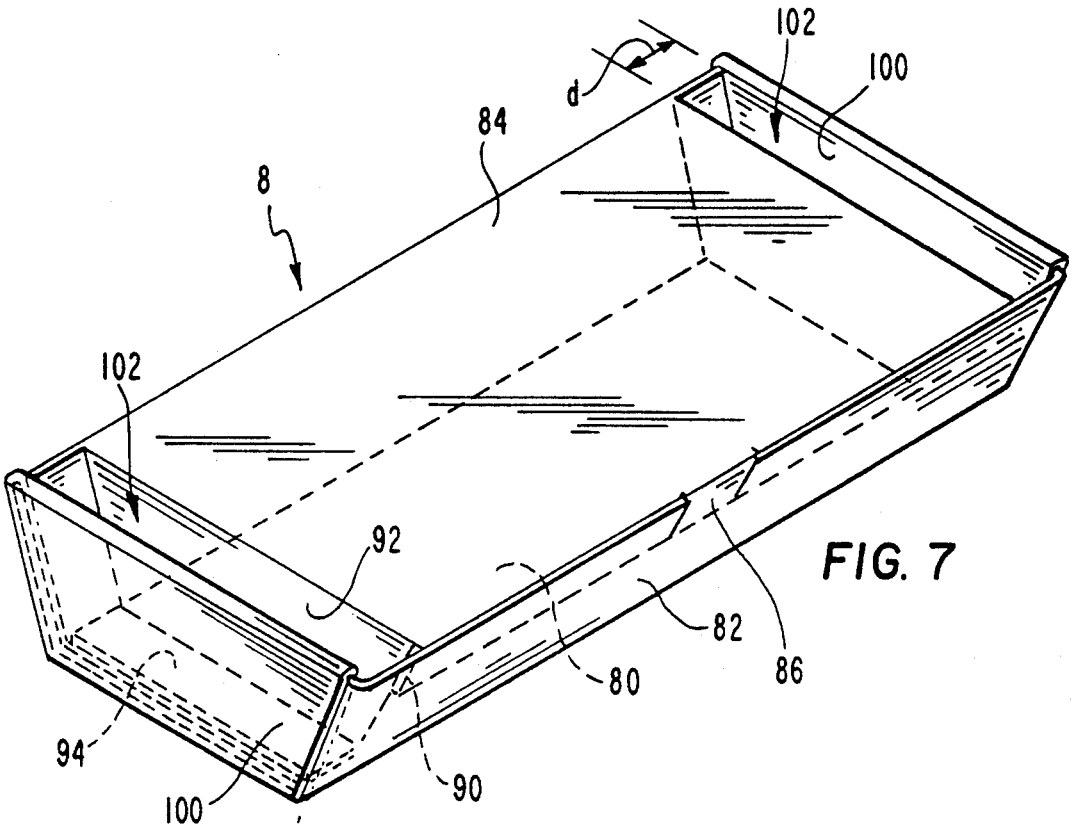
FIG. 7
FIG. 8
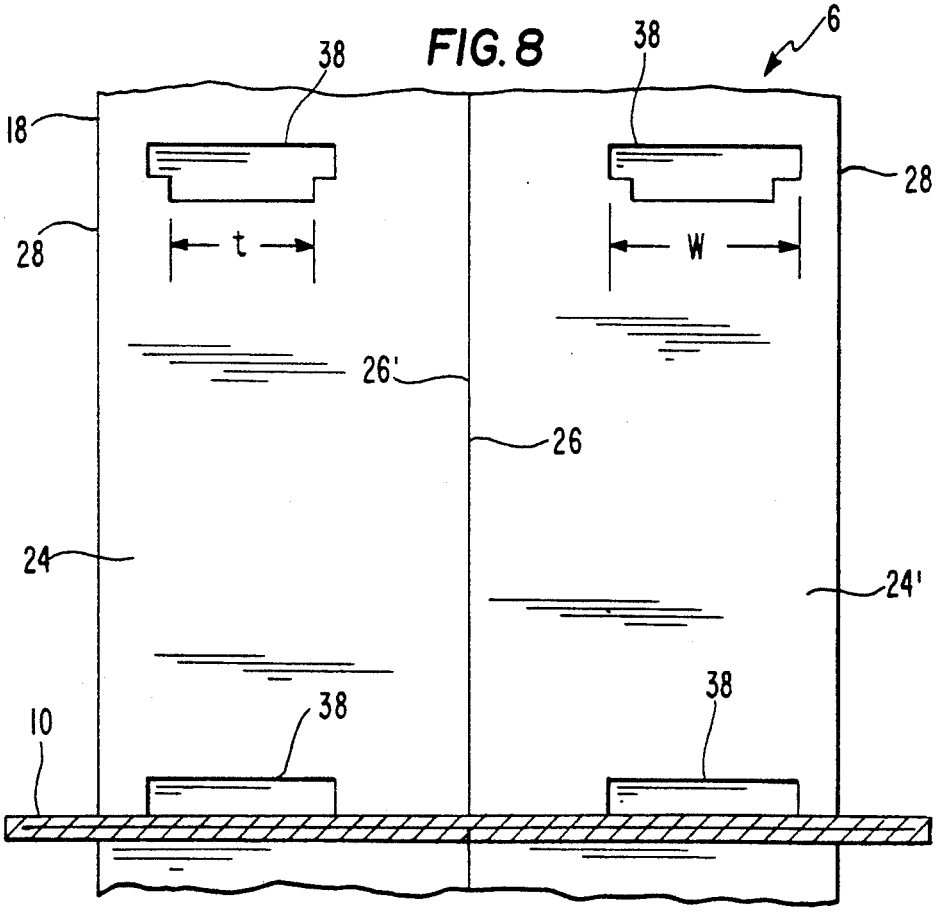

COLLAPSIBLE DISPLAY STAND

BACKGROUND OF THE INVENTION

1. Field of the Invention

This invention relates to paperboard collapsible display stands comprising a plurality of collapsible self supporting panels to which merchandise display shelves are secured, and more particularly, to corrugated paperboard display stands.

2. Cross Reference

Of interest is copending application entitled Corrugated Display Stand Ser. No. 744,872 filed Aug. 14, 1991 in the name of the present inventor.

3. Description of the Prior Art

Paperboard display stands typically sheet corrugated cardboard material comprise a plurality of side, front and back panels which are self supporting in an upright display mode. These stands are collapsible in which the panels usually fold upon each other and the shelves are either removable or foldable with the panels. The objective is to provide portable stands which are easily erected to the display mode and readily collapsed for storage or transport to a different location. Further, low cost and durability are common goals. These stands usually are employed in retail establishments for display of merchandise, the panels and at times, the shelves, often carrying advertising for selling the displayed merchandise.

The prior art side and back, and in some instances, front panels typically are formed from common sheet material which has crease lines separating the different panels so that they are hinged to each other. The hinges permit the panels to fold and unfold as desired. For example, U.S. Pat. Nos. 4,506,790; 4,519,319; 4,493,424; 4,942,830; 4,854,246 and 3,987,737 all show stands which comprise side and rear panels and in some cases, front panels, which are formed from a single sheet of material. As by way of example, in the '737 and '319 patents (the last three digits of the patent numbers) the walls comprise doubled over sheet material to increase their strength. In '790, the side and rear panels are a single sheet with an insert structure for supporting shelves which are also supported by the displayed merchandise.

In '319; '424 and '246, front, back and side panels are all formed from the same sheet material and foldable as a unit. In '246 the shelves are accessible from all sides while in '424 and '737 the shelves are accessible only from the front. The above patents are representative of a wide assortment of collapsible paperboard display stands. While the '246 structure is accessible on all sides it is relatively complex in appearance. The '830 patent employs a shroud over an interior shelving structure which makes this relatively complex to collapse. The shelves are not disclosed as being readily removable with the shroud in place.

SUMMARY OF THE INVENTION

The present inventor recognizes a need for an attractive neat looking collapsible display stand that can stand relatively tall, is relatively rigid in the display mode, the shelves are readily removable, is accessible from a number of sides and is portable when collapsed. In a paper board display stand having collapsed and extended display states, according to an embodiment of the present invention, a combination comprises first and second facing planar relatively rigid elongated box-like side members having a hollow core, each member having top and bottom ends and collapsible stiffening means hingedly secured to a portion of the side members, the stiffening means for selectively bracing the portion of the side members in a spaced parallel extended state and selectively collapsing such that the side members move toward one another to a collapsed state whereby the side members extend beyond the stiffening means in an upright condition.

In accordance with one embodiment, the stiffening means is at the bottom ends, the stand including a cap member removably secured to the top ends of the spaced extended side members, the cap member for bracing and releaseably securing the extended top ends.

In accordance with a further embodiment, an article receiving tray is included, the tray including a bottom wall and an annular wall upstanding from the bottom wall periphery removably secured on the at least one shelf.

In a still further embodiment, the side members each comprise a relatively thin rectangular in transverse section elongated box-like structure with a hollow core and opposing relatively broad side walls extending along the length thereof.

In a further embodiment, each side member comprises a second elongated box-like member secured to each side member and abutting the broad side walls nested within the core of each side member for stiffening the box-like structures.

BRIEF DESCRIPTION OF THE DRAWING

FIG. 7 is a fragmentary isometric view of the cap used in the embodiment of FIG. 1;

FIG. 8 is a side elevation view of an interior portion of a side member with a tray supporting shelf in place;

DESCRIPTION OF THE PREFERRED EMBODIMENT

Figure 1:
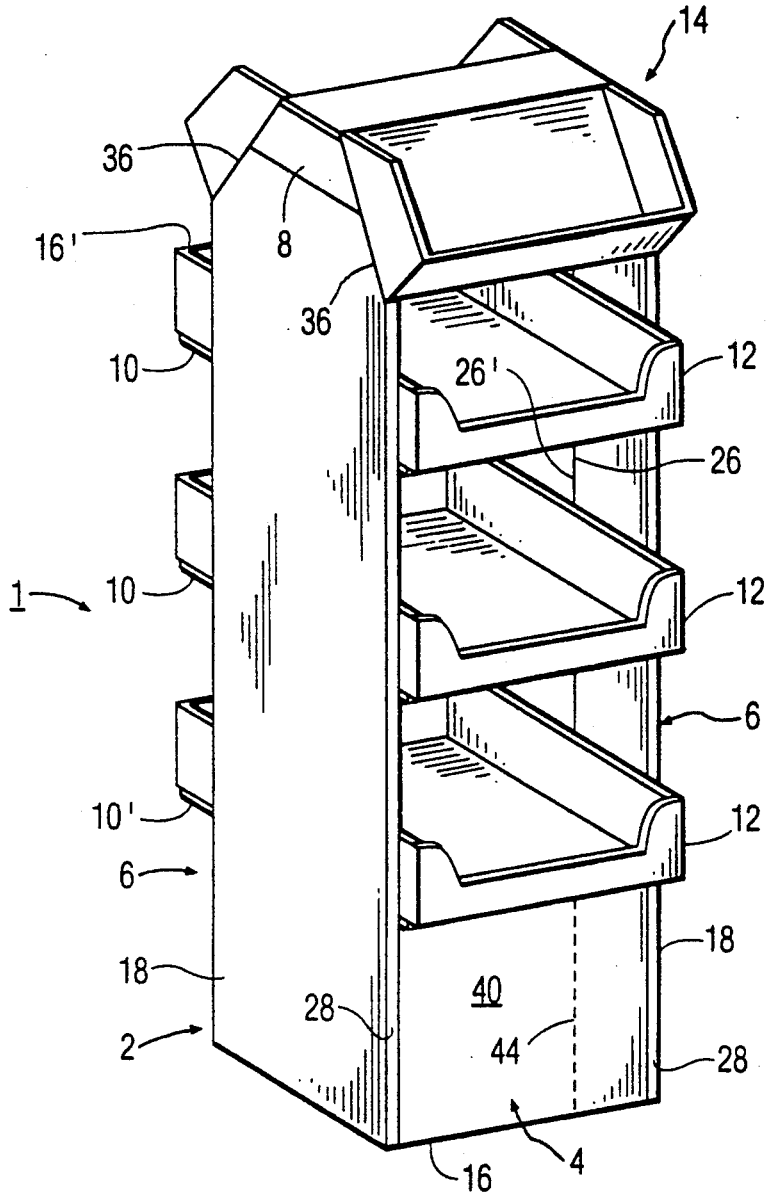
FIG. 1 is an isometric view of a display stand according to one embodiment of the present invention.

In FIG. 1, the assembled display stand 1 is in the display state ready to receive merchandise for display. The stand 1 comprises a side panel assembly 2 comprising a stiffening collapsible box 4 and a pair of upright identical substantially rigid parallel side members 6. The stand further comprises a stiffening cap 8 and a plurality of tray supporting shelves 10. A plurality of like trays 12 are each supported by a corresponding shelf 10. An upper tray assembly 14 is supported by cap 8 and straddles the cap 8 at opposing front and rear sides 16 and 16', respectively, of the stand 1.

The trays 12 receive and hold merchandise for display and are accessible from the front 16 and rear 16' sides. The trays are readily removed from the stand for replacement with other like trays, the different trays for example bearing different advertising (not shown) for different merchandise to be displayed, the different merchandise, for example, being offered by a common source, whose general advertising may appear on the various panels and surfaces of the stand 1. The trays do not add to the strength of the stand in the display state and, therefore, their removal does not detract from the rigidity of the stand 1 in the display state. The stand can be relatively tall, for example five feet or more in height, while being relatively rigid.

The shelves 10, cap 8 and box 4 all serve to stiffen the stand in the display stand, and yet, are all easily removed, in the case of the cap and shelves, or collapsible, in the case of the box 4, to permit the relatively rigid side panel assembly 2 side members 6 to collapse as a unit separate from the shelves 10, cap 8 and trays 12. The shelves and cap 8 serve an important function of making the stand assembly relatively rigid regardless the height of the side members 6. Additional shelves are included as the height of the stand is increased. The box 4 provides a durable rigid brace and support structure for the erect stand.

Figure 2:
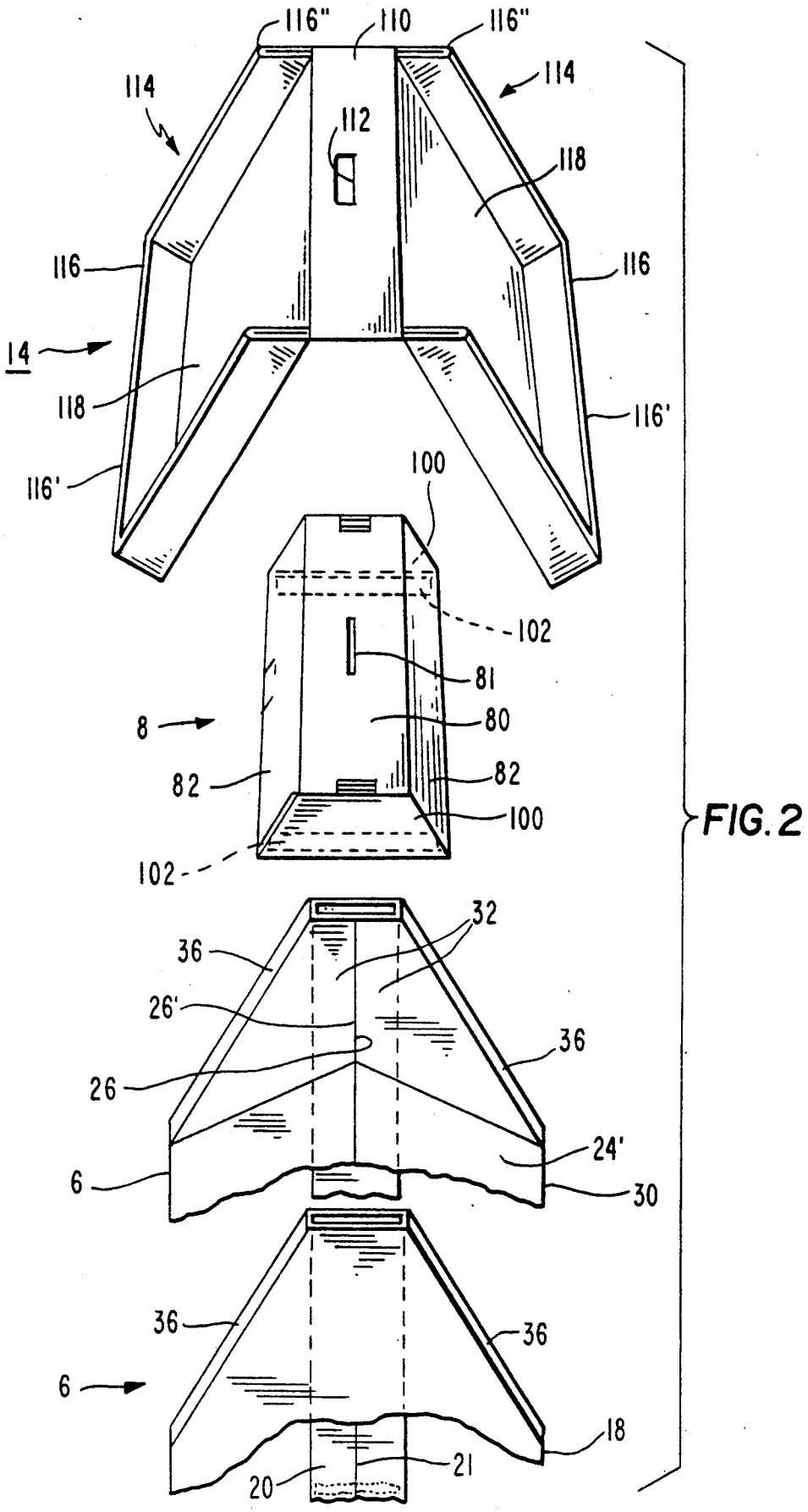
FIG. 2 is an exploded fragmentary isometric view of the top portion of the display stand of FIG. 1.
Figure 9:
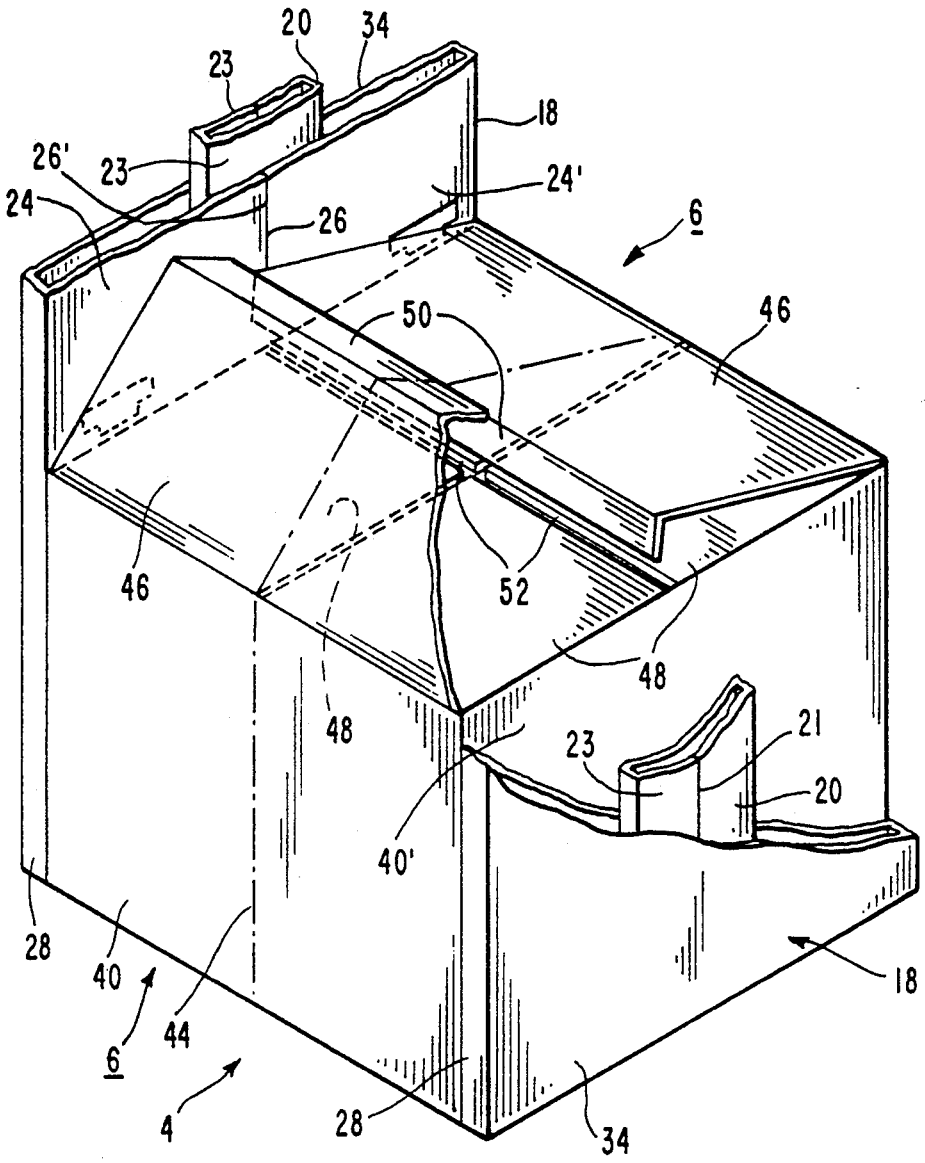
FIG. 9 is a fragmented isometric view of a stiffening collapsible box-like structure used to stiffen the side members of FIG. 1 in the display state.

The side members 6 of assembly 2 are identical and, therefore, a description of one is representative. In FIGS. 2 and 9, side member 6 comprises a tubular rectangular in transverse section outer member 18 and a tubular rectangular in transverse section inner member 20. The inner member 20 is nested centrally along the long axis within the core of the outer member 18 and extends substantially from end to end of the outer member The outer member 18 and inner member 20 each comprise a single sheet of corrugated paperboard. The term paperboard as used herein refers to corrugated and uncorrugated paper products including cardboard material which is fabricated in a variety of thicknesses and stiffness. Corrugated products may comprise single ply and multiple ply each ply comprising an undulating paper sheet sandwiched between two planar paper sheets and glued thereto. In the present embodiment, the paper product forming the various structures are single ply corrugated sheets.

Figure 11:
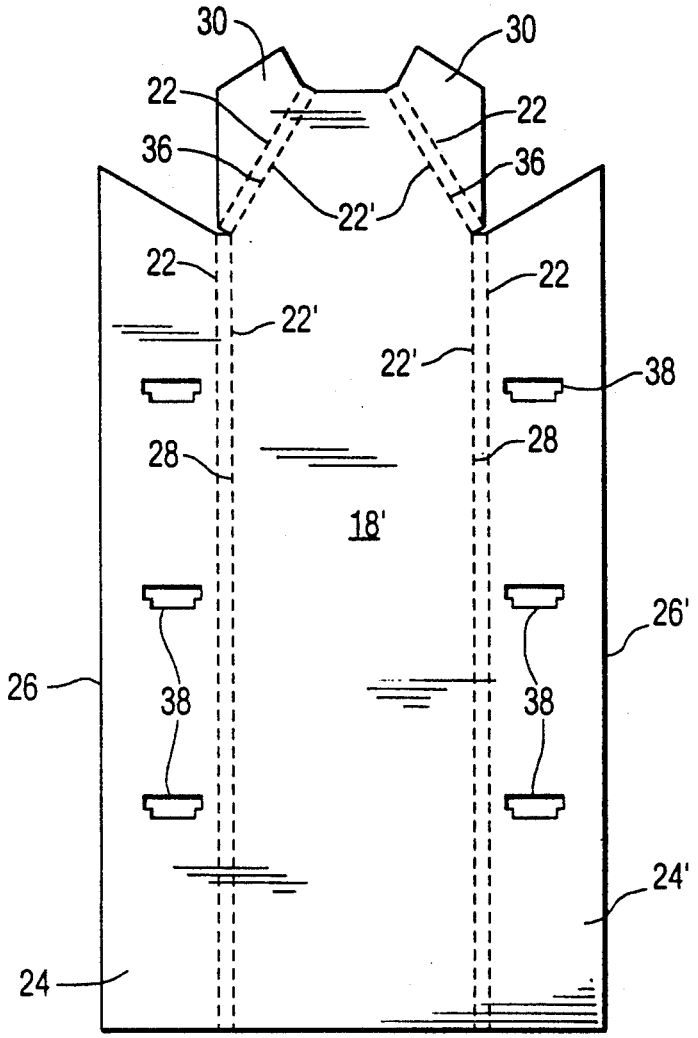
FIG. 11 is a plan view of a sheet of material used to construct the external portion of each side member of FIG. 1.

As best seen in FIG. 11, single sheet 18' is used to form the outer member 18. The dashed lines 22 and 22' represent creases at which the portions of the sheet 18' fold. Identical panel portions 24 and 24' fold at creases 22 and 22' so as to have abutting edges 26 and 26'. The outer member 18 edge 28 is formed by the portion between creases 22 and 22' forming the outer member into an elongated box. Two polygon sections 30 form a tapered top portion 32 of an inner side of member 18 facing the interior of assembly 2. The outer side 34 of member 18 is formed by the portion between creases 22'. The inner side of members 18 facing one another is formed by portions 24 and 24'. The upper part of the member 18 is trapezoidal with two opposing sloping edges 36. A plurality of like T shaped openings 38 are formed in panel portions 24 and 24' having a top width w and a narrower stem width t. The openings are aligned vertically and horizontally when the stand is erect in the display mode.

The inner member 20, FIGS. 2 and 9, comprises a single sheet material folded over similarly as member 18 to form a tubular elongated box with abutting longitudinal edges 21. Member 20 has broad side walls 23 significantly smaller in width than that of member 18 and is central within the core of member 18. The abutting edges 21 of member 20 form a seam which abuts the broad seamless side wall of outer member 18. Similarly, the seam of outer member 18 formed by edges 26 and 26' abuts the seamless broad side wall of member 20. Member 20 is closely received within the core of member 18 and is bonded to member 18 to stiffen the structure and secure the seams in place. The inner member 20 has an end flap (not shown) which encloses each member 20 end to form a closed box. The end flap stiffens the corresponding member 20 end.

Figure 10:
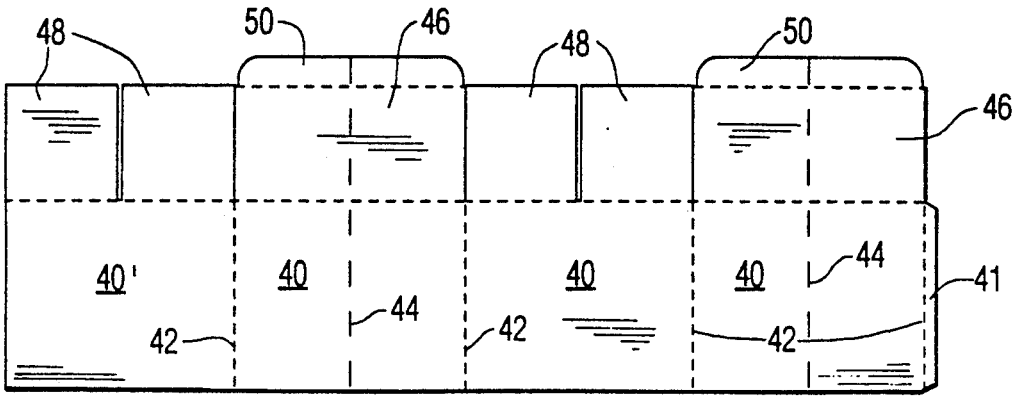
FIG. 10 is a plan view of a sheet of material used to construct the stiffening structure of FIG. 9.

The stiffening box 4, FIGS. 9 and 10, comprises a single sheet of paperboard having a plurality of panels 40 joined by creases represented by the dashed lines 42. A side flap 41 is bonded to a panel 40' to form the box. Creases 44 in opposing panels 40 are parallel to creases 42. The creases 44 may be central in the corresponding panel 40 or offset, this is not critical. A flap 46 extends from alternate panels 40 and a pair of like flaps 48 extend from each of alternate panels 40 and 40' between flaps 46. Flaps 46 have flap ends 50 which tuck into the slots 52 formed by flaps 48, FIG. 9. When so tucked with the flaps 48 folded as shown in FIG. 9, the box 4 is relatively stiff and braces the two side members 18 in the extended display state. Opposite panels 40 are bonded to the interior facing surfaces of members 18. In the alternative, opposite panels 40 secured to facing surfaces of members 18 may be replaced with vertical flaps extending parallel to crease 44 and (similar to edge flaps 50 and not shown) coupled to panels 40 with bend creases parallel to creases 44. These flaps (not shown) are then bonded to the facing surfaces of outer members 18. Flaps corresponding to flaps 48 can then be secured to the side members by hinged edge flaps (not shown).

Figure 4:
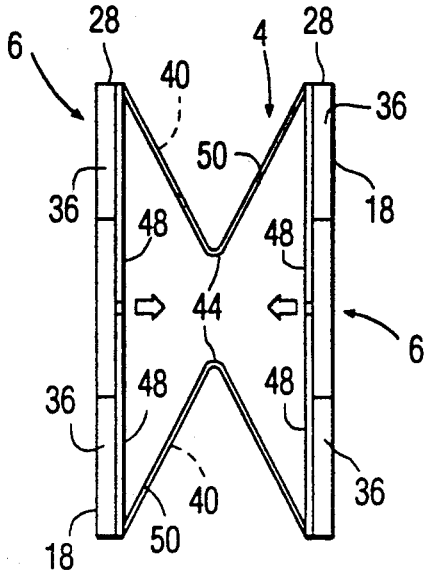
FIG. 4 is a plan view of the stand of FIG. 1 partially collapsed.
Figure 5:
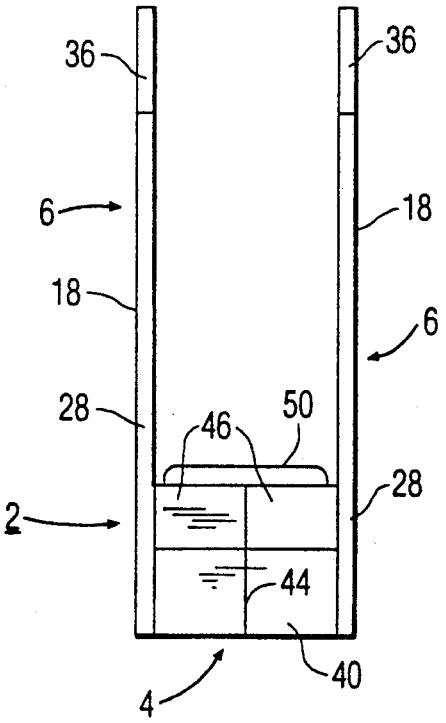
FIG. 5 is a side elevation view of the side member portion of the stand of FIG. 1 with the shelves, trays and cap removed and ready to be collapsed.

The creases 44 extend in a continuous line into the flaps 46 and flap ends 50. Creases 44 form a continuous crease when the flaps 46 and flap ends 52 are positioned in the same plane as panels 40 as seen in FIGS. 5 and 10. In this orientation, the creases 44 serve as a fold line about which the coplanar panel 40, flap 46 and flap end 50 portions on both sides of these creases may fold against one another as shown in FIG. 4.

Figure 3:
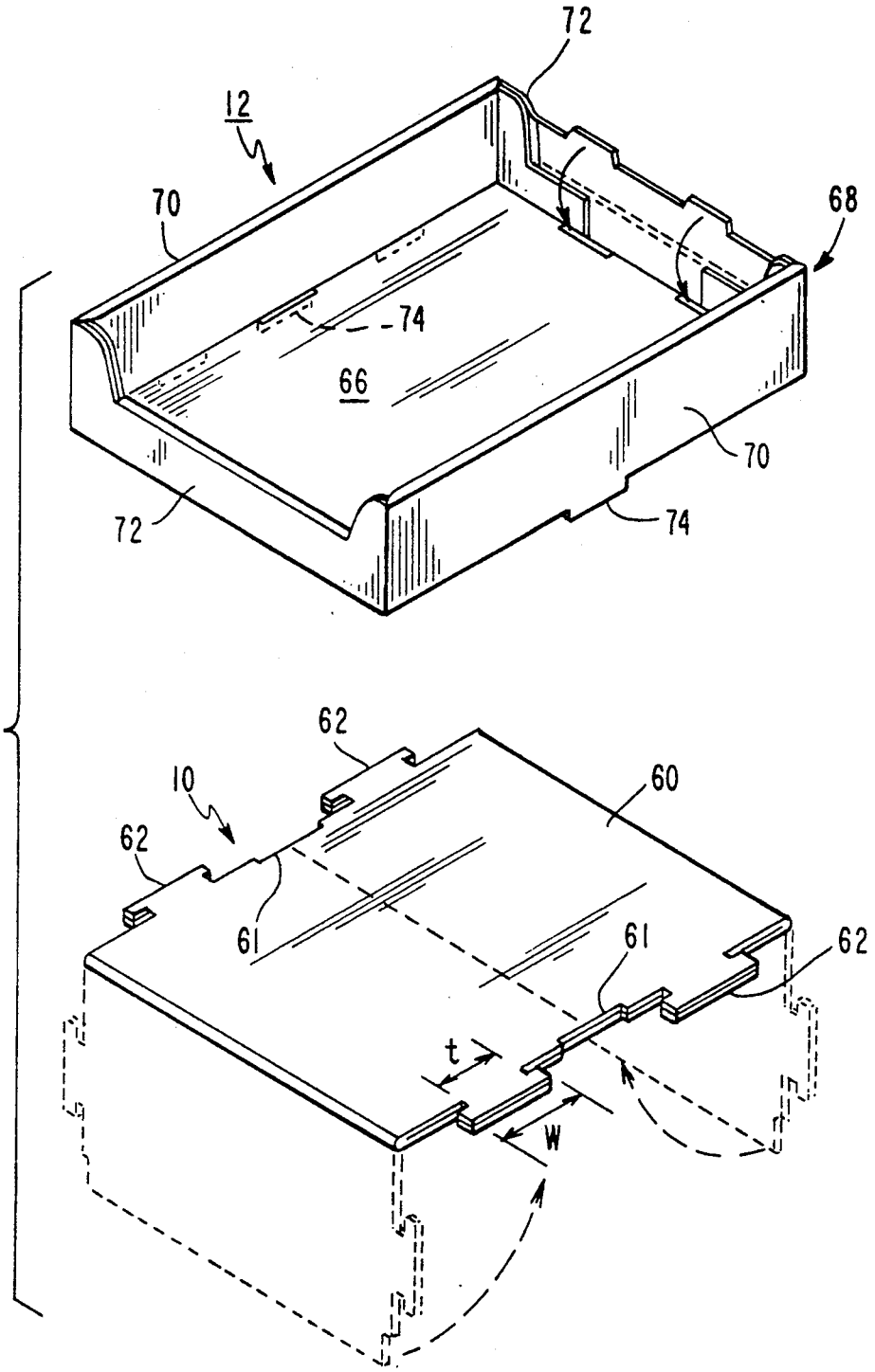
FIG. 3 is an isometric exploded view of a shelf and tray used in the embodiment of FIG. 1.

In FIG. 3, a typical shelf 10 comprises a single sheet material as shown by the dashed and solid lines, the dashed lines showing a lower portion prior to forming the shelf 10. Shelf 10 comprises a rectangular shelf member 60 comprising upper and lower abutting portions and having a pair of T shaped tabs 62 of like dimension extending from each side of member 62. The tabs have a maximum width of w for insertion in opening 38 FIG. 8 in the corresponding width w of opening 38. The tabs have a narrower stem width t which mates with the stem width t of opening 38 for interlocking the tab in the corresponding opening 38. The width w of opening 38 is above the stem width t so that after the tab is inserted, the shelf is pushed down so that the tab stem enters the opening stem, locking the tab to the side member. The lower portion of the shelf comprises two lower halves (in phantom) which are folded against the upper portion of shelf member 60. A notch 61 is formed between the pair of tabs 62 on each shelf side.

Two tabs 62 are inserted in the corresponding openings 38 by spreading the side members 6 apart, FIG. 5, an amount sufficient to permit the tabs 62 to enter the space between the side members. The two side members 6 are relatively flexible with respect to each other and are easily spread apart for the shelf assembly process. This is so even with the box 4 placed in the stiffening mode. The shelves 10 are assembled until all shelves are in place. Preferably the shelves 10 are assembled to one side member 6 first and then to the other side member in sequence. First the wide tab portions are inserted into the openings 38 for each shelf and then after the shelves are so inserted, the shelves are locked in place by pushing down on the shelves until the t stems of tabs 62 engage the t portion of openings 38. The shelf 10' closest to the box 4 can be inserted by flexing outwardly the side members 6, which are still relatively flexible with respect to box 4, regardless that the side members 6 are relatively stiff. The box 4 because of its proximity to this shelf necessarily must be placed in the stiffening condition first. Otherwise, the box 4 can be in the foldable state of FIG. 5 during assembly of the remaining shelves, but preferably is placed in the stiffened state first. The shelf 10 closest to the box 4 covers the box 4 flaps 46 and 50 to provide a pleasing appearance.

Figure 12:
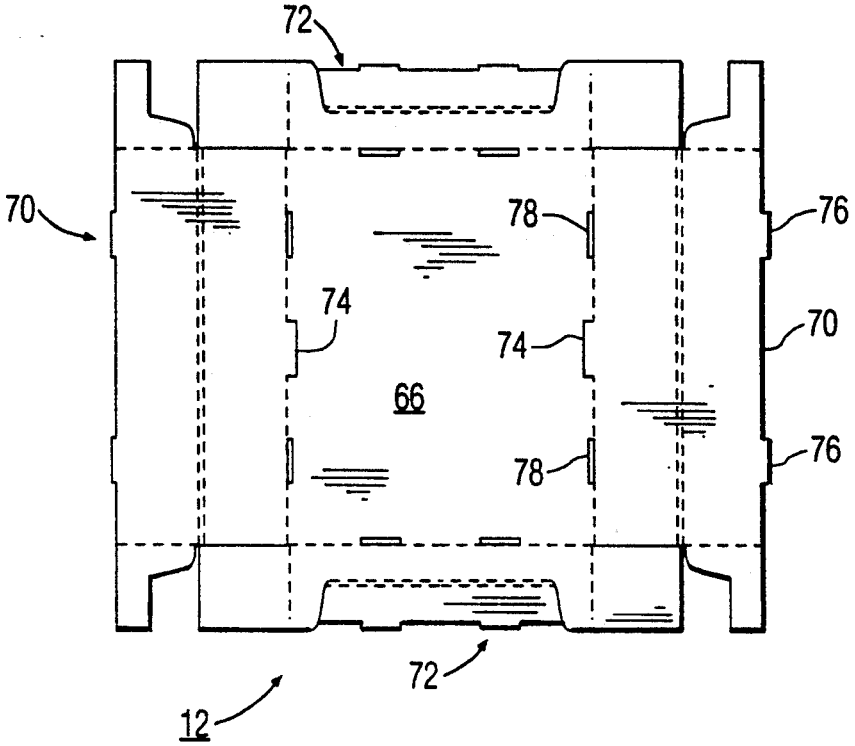
FIG. 12 is a plan view of a sheet of material used to construct a tray which rests on a shelf.

A representative tray 12 is shown in FIGS. 3 and 12. Tray 12 comprises a bottom wall 66. An upstanding peripheral wall 68 is attached to the periphery of the bottom wall 66. Wall 68 comprises two opposing side rails 70 which extend from front to back of the tray and two opposing rails 72 each at the front and back forming a continuous wall. The front and back rails 72 have a lowered top rail edge to permit access to the tray in the display state. The dashed lines in FIG. 12 show the fold lines, this figure being self explanatory. A tab 74 is formed in the inner sheet of each of the side rails 70. The tabs 74 depend from the tray 12 and are inserted in a corresponding notch 61 of the supporting mating shelf 10. By merely lifting or dropping a tray onto a shelf, the tabs 74 enter or are released from the notches 61 allowing easy vertical replacement of the trays while locking the trays in place horizontally. In FIG. 12, a pair of tabs 76 are formed on each side rail 70 and a pair of mating notches 78 are formed in the bottom wall 66 to lock the side rails in place. Similar tabs and notches lock the front and back rails in place.

Figure 14:
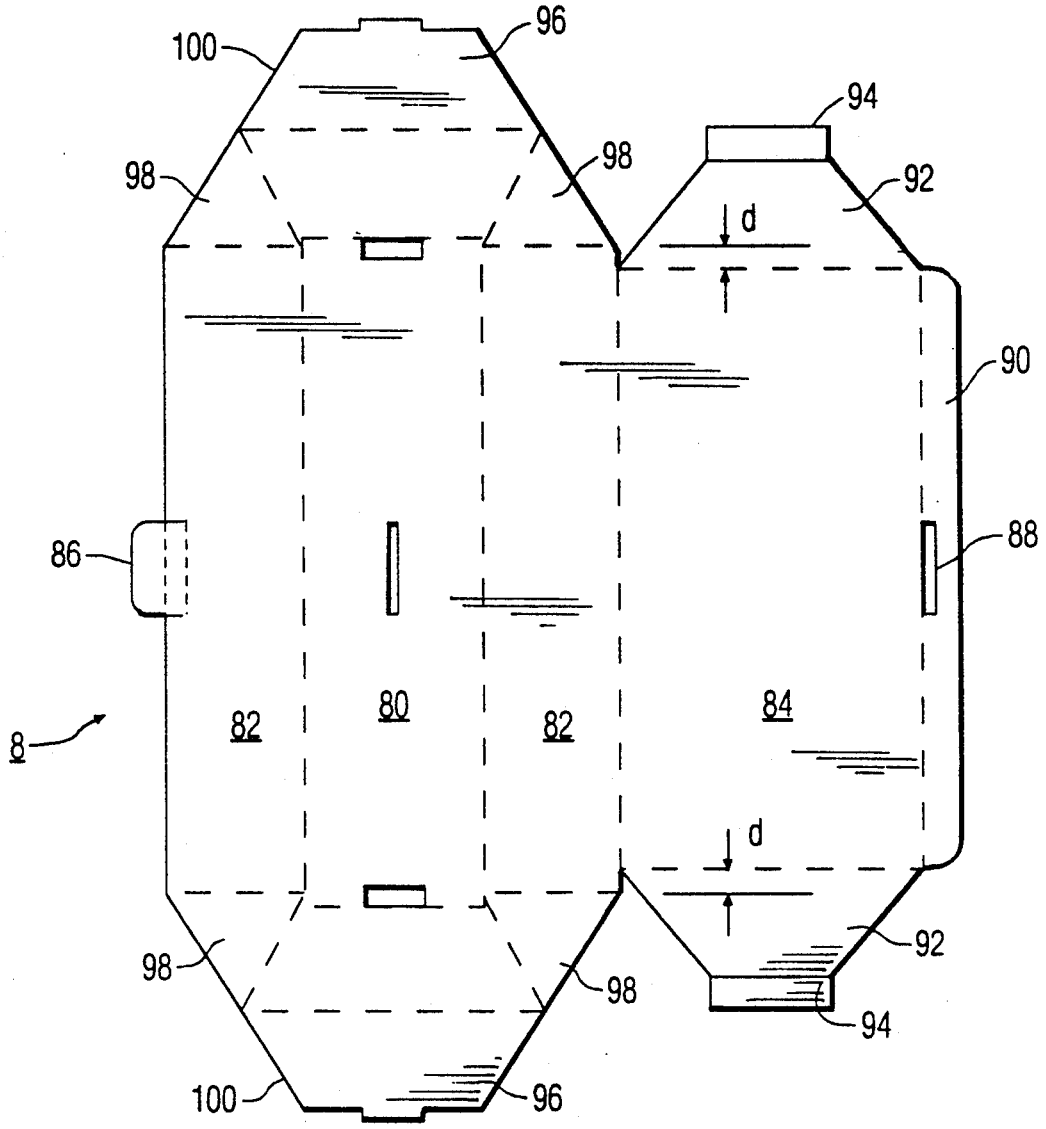
FIG. 14 is a plan view of a sheet of material used to construct the cap of FIG. 7.

In FIGS. 7 and 14, cap 8 is formed from a single sheet material. The cap 8 has a central top member 80 and two sloping side walls 82. A bottom wall 84 folds over and tab 86 mates with slot 88 to lock the cap as shown. Flap 90 tucks against the interior of wall 82. Extending from each end of bottom wall 84 are two flap members 92 and flaps 94, the latter abutting top member 80. The cap 8 has two like ends 96 which fold over triangular flaps 98 to form trapezoidal end walls 100. The end walls 100 are each spaced from flap members 92 to form a recess 102 in bottom wall 84 at each cap end. The recess 102 has a width d which is slightly wider than the uniform width of side members 6 represented by the width of edge 28. The cap is assembled to the tops of the side members 18 by inserting their wedge-like narrow tops into the recesses 102 in close fit. The cap thus locks the members 6 horizontally in the display state bracing the members at the top region of the assembly. The cap merely slips on and off the side members 68. The cap central top member 80 forms a top brace surface of the assembly and has a central slot 81.

Figure 13:
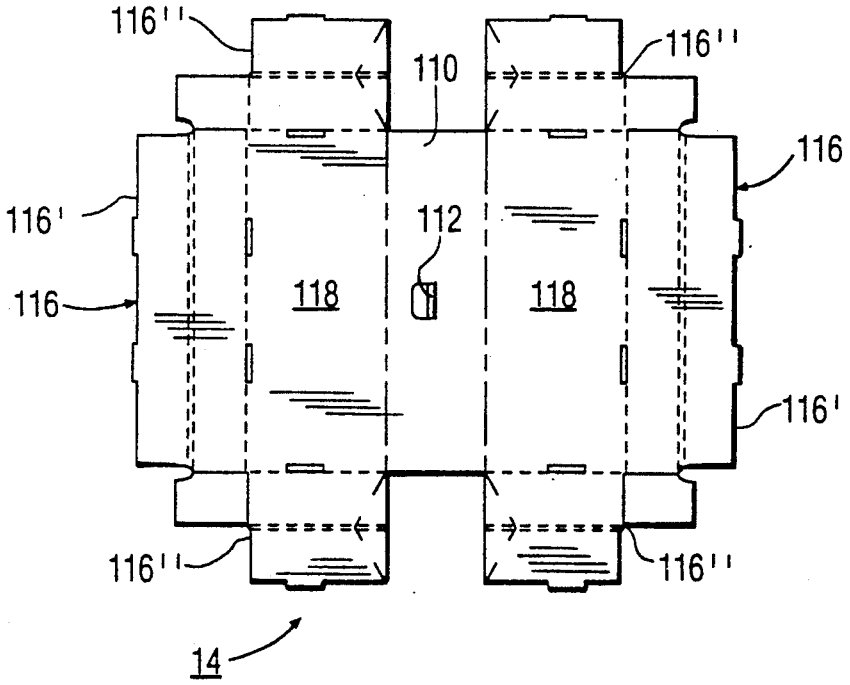
FIG. 13 is a plan view of a sheet of material used to construct a tray assembly which rests over the cap of FIG. 1.

In FIGS. 1, 2 and 13, the tray assembly 14 rests over the cap 8 and comprises a central wall 110 which sits on top of cap member 80. A tab 112 depending from wall 110 mates with and engages slot 81 of cap 8. The broken lines in FIG. 13 are fold lines. The tray assembly includes two like trays 114 which extend from wall 110 at opposite edges thereof. The trays 114 have U shaped side rails 116 formed similarly as the rails of the trays 12. Side rails 116 comprise rails 116' and 116" at the respective front (the front and rear of the stand is the "front" in this description) and side edges of the tray 114 bottom wall 118. The bottom walls 118 sit on the respective sloping side walls 82 of cap 8 and sloping edges 28 of the side members 18.

Figure 6:
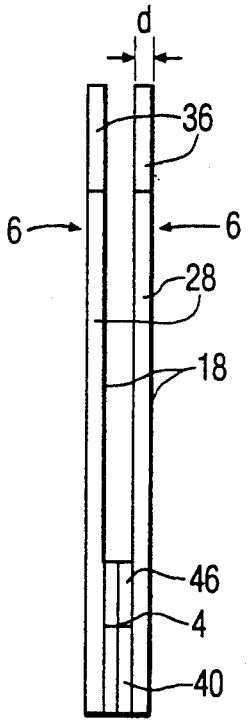
FIG. 6 is a side elevation view of the embodiment of FIG. 5 with the side member portion collapsed.

To collapse the stand, the tray assembly 14 and cap 8 are removed first. The trays 12 are then removed by lifting. The shelves 10 are then lifted to release their tabs from the openings 38. The side members 6 are then spread apart to disengage the shelf tabs from the openings. The shelf next to the box 4 is removed by spreading the side members apart to release the shelf tabs. After the shelves are removed, the flaps of the box 4 are unfolded to an upright vertical state parallel to the side panels 40. At this time the side members 6 are displaced toward each other as shown in FIGS. 4 and 6. In this manner, the side members 6 can be relatively tall while not detracting from their portability in the collapsed state.

A pleasing appearance display stand has been described which is uncluttered in appearance and yet is extremely sturdy and durable. It is capable of being collapsed quickly, is light weight and portable. While the shelves, trays and cap are separated from the stand when collapsed, they are portable and light. The main structure comprising the side panel assembly 2 is also light weight and durable, the side members 6 being relatively rigid and thus withstand the rigors of numerous assembly and disassembly operations. The interlocking tab and opening arrangement for the shelves quickly stiffens the stand when in the display mode yet do not interfere with frequent replacement or changing of the trays. The relatively rigid side members 6 allow these members to be relatively tall for use with a number of shelves while providing a stiff structure in the presence of the various braces employed. For example, the side members 6 may be about sixty one inches tall with a width of about 16 inches with a side edge 28 width of outer member 18 of about one inch. In contrast the shelves 10 and trays 12 can be respectively about $20\times16$ inches and $21\times16$ inches. The box 4 can have panels 40 of about $16\times13\frac{1}{2}$ inches.

The outer skin layers of the corrugated paperboard forming the trays, shelves, side members, cap and tray assembly may be formed with white finishing paper to provide a pleasing cosmetic look to the stand. By providing inner member 20 and an outer member 18, these members may each be formed of single ply corrugated cardboard as compared to double thickness folded over side and rear panels as used in many prior art structures. The inner member 20 uses substantially less material than the outer member 18 therefore permitting a less costly structure having significant strength as compared to prior art structures using doubled over or single ply side and rear panels.

What is claimed is:

1. A paperboard display stand having collapsed and extended display states comprising:

first and second facing tubular side members each rectangular in transverse section and having top and bottom ends, each member being formed from at least one different single sheet of paperboard;

collapsible stiffening means hingedly secured to a portion of each said side members, said stiffening means for bracing said portion of side members in a spaced parallel extended state and to selectively collapse such that said side members move toward one another; and at least one shelf removably secured to and between the spaced extended side members in a region spaced from said stiffening means, said at least one shelf being arranged for interlocking with and bracing said extended side members.

2. The stand of claim 1 wherein said stiffening means is at said bottom ends, said stand including a cap member removably secured to said top ends of said spaced extended side members, said cap member for bracing and releaseably securing said extended top ends.

3. The stand of claim 1 further including an article receiving tray including a bottom wall and an annular wall upstanding from the bottom wall periphery removably secured on said at least one shelf.

4. The stand of claim 2 further including removable tray means resting on said cap member for providing at least one article support tray at said top ends.

5. The stand of claim 4 wherein the top ends of said side members each have a pair of opposing sloping edges inclined relative to the force of gravity, said cap member being adapted to rest on said top ends including said edges and having like inclined opposing side walls, said tray means being arranged to receive and support articles thereon and including a pair of tray bottom walls each resting on a different inclined side wall.

6. The stand of claim 1 wherein said side members each comprise a relatively thin rectangular in transverse section elongated box-like structure with a hollow core and opposing relatively broad side walls extending along the length thereof.

7. The stand of claim 6 wherein each side member comprises a second elongated box-like member secured to and nested within the core of each side member and abutting the broad side walls for stiffening said side members.

8. The stand of claim 1 wherein each said side members have a plurality of spaced openings, said openings lying in a plane while said side members are extended in a display state, said at least one shelf including a plurality of tabs, each said opening for receiving a corresponding tab, said openings and tabs being arranged to interlock.

9. The stand of claim 8 including at least one removable article support tray for resting on said at least one shelf, said shelf defining at least one slot, said tray having at least one depending tab which mates with said at least one slot.

10. The stand of claim 4 wherein said cap member has an opening, said tray means including a projection which engages said opening for releaseably securing the tray means to said cap member.

11. The stand of claim 2 wherein said cap member includes a top and a bottom wall, a pair of opposing side walls and a pair of opposite trapezoidal end walls joining said side, top and bottom walls, said bottom wall terminating spaced from said end walls to form a pair of recesses between said bottom wall and end walls, each recess being dimensioned to receive a different top end.

12. The stand of claim 1 wherein said side members each have front and rear edges and facing side walls, said stiffening means comprising front and rear panels each having a hinge portion secured to said facing side walls at said front and rear edges for rotating against said side walls during said collapsing and forming with the side walls an enclosed annular member when extended, said panels each having a crease parallel to and intermediate said side walls such that each panel folds against itself and the facing side walls when collapsed, and flap means secured to said side walls and to said panels for releaseably locking said panels and bracing said side members in the extended display state.

13. A paperboard display stand having collapsed and extended states comprising:

first and second paperboard side members having opposite bottom and top ends, said members having juxtaposed spaced apart extended and closely spaced collapsed states;

a collapsible paperboard box-like member secured to a portion of said side members at the bottom ends for providing substantially rigid support to said portion in said extended state and collapsible with said side members to the collapsed state;

a paperboard cap member releaseably secured to the top ends of said side members for rigidly bracing said top ends in said extended state;

at least one tray support shelf removably secured to and between the spaced apart extended side members in a region spaced from said box member and said cap member; and an article receiving tray removably secured on said at least one shelf.

14. The stand of claim 13 including a reinforcing member secured to each said side members along the length of that side member.

15. The stand of claim 14 wherein said side members each comprise an elongated box-like structure with a hollow core and a pair of opposing side walls, said rib member comprising an elongated box-like member secured to each side member and abutting the side walls within the core.

16. The stand of claim 13 including a pair of removable trays dimensioned and shaped for resting on said cap member, said cap member having an upper central portion, said pair of trays comprising a single bottom wall having a pair of spaced creases defining a central region for resting over the cap central portion, said single bottom wall extending in opposite directions from said creases for forming said pair of trays.

17. The stand of claim 16 wherein said cap member has two opposite sloping side walls depending from the central portion, said cap member having two recesses, each for receiving a different mating end of a side member, each of said trays resting on a corresponding cap member sloping wall.

18. A paperboard display stand having collapsed and display states comprising:

first and second box-like reinforced relatively rigid paperboard side members having bottom and top ends, said members having juxtaposed spaced apart display and closely spaced collapsed states;

a collapsible stiffening member comprising a pair of spaced collapsible creased paperboard panels secured to a portion of said side members at the bottom ends and flap means hingedly secured to said side members and panels for locking said panels and bracing said portion in said display state;

a cap member releaseably secured to the top ends of said side members for rigidly bracing said top ends in said display state; and at least one shelf removably secured to and between the spaced apart extended side members in a region between said stiffening member and said cap member.

19. The stand of claim 18 including an article receiving tray means removably secured on said at least one shelf and said cap member.

20. The stand of claim 19 wherein said tray means includes first tray means comprising a tray having a bottom wall and a peripheral side wall extending from at least a portion of said bottom wall adapted to be secured on said one shelf and second tray means adapted to be secured on said cap member and including sloping tray portions depending from the cap toward the bottom ends.

21. In a paperboard display stand having collapsed and extended display states, the combination comprising:

first and second facing planar relatively rigid elongated box-like side members having a hollow core, each member having top and bottom ends; and collapsible stiffening means hingedly secured to a portion of said side members, said stiffening means for selectively bracing said portion of side members in a spaced parallel extended state and to selectively collapse such that said side members move toward one another to a collapsed state whereby the side members extend beyond the stiffening means.

22. The combination of claim 21 wherein the side members each comprises nested inner and outer elongated hollow box-like structures.

23. The combination of claim 22 wherein each said structures comprise a single sheet of paperboard having abutting edges extending along the length of that box-like structure on one side thereof, each structure having opposing broad side walls, the abutting edges of the inner and outer structures each lying on one of the broad side walls of that structure, said abutting edges of one structure being bonded to that broad side wall of the other of said nested structures opposite the abutting edges of said other side wall.

24. The combination of claim 21 wherein the side members are rectangular in transverse section.

25. The combination of claim 21 wherein each member is formed with spaced opposing broad side walls, one of said side walls of each member facing each other, said one side walls including tab receiving openings for releaseably securing a plurality of spaced shelve means to and between said broad side walls for bracing said side members and for receiving display articles.

26. The combination of claim 21 further including a plurality of spaced shelves secured to and between said side members arranged for bracing the side members, a plurality of trays, each on a different shelf and cap means releaseably secured to said side members at said top ends for bracing said top ends.

27. The combination of claim 21 wherein said stiffening means is secured to a bottom portion of said side members adjacent to said bottom ends for forming with said bottom ends a stand support structure in the extended display state.

* * * * *